US006461178B1

(12) United States Patent
Fu

(10) Patent No.: US 6,461,178 B1
(45) Date of Patent: Oct. 8, 2002

(54) ELECTRIC CONNECTOR AND ADAPTER ARRANGEMENT

(75) Inventor: Huang-Lung Fu, Panchiao (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 09/981,704

(22) Filed: Oct. 19, 2001

(51) Int. Cl.[7] ..... H01R 27/00
(52) U.S. Cl. ..... 439/224; 439/660
(58) Field of Search ..... 439/79, 660, 218, 439/224, 221, 222, 954

(56) References Cited

U.S. PATENT DOCUMENTS 5,971,784 A * 10/1999 Fabian et al. ..... 439/224
6,027,353 A * 2/2000 Kamagai ..... 439/224
6,171,126 B1 * 1/2001 Wu et al. ..... 439/224

* cited by examiner

*Primary Examiner*—Gary F. Paumen
(74) *Attorney, Agent, or Firm*—Bacon & Thomas, PLLC

(57) ABSTRACT

An electric connector and adapter arrangement in which the housing of the electric connector defines a series of terminal chambers each having a top entrance and a front entrance, and the housing of the electric adapter has a plurality of vertical insertion strips that can be inserted with the electric adapter into the terminal chambers from the top entrance or front entrance selectively to force the terminals of the electric adapter into close contact with the terminals of the electric connector.

9 Claims, 8 Drawing Sheets

ELECTRIC CONNECTOR AND ADAPTER ARRANGEMENT

BACKGROUND OF THE INVENTION

The present invention relates to an electric connector and adapter arrangement for use to connect a computer peripheral apparatus to a computer and, more particularly, to such an electric connector and adapter arrangement, which requires less installation space.

Following fast development of computer technology, computers are made smaller and faster. In order to fit small dimension requirements, electric connectors must be made as thinner as possible. FIGS. 10 and 11 show a conventional electric connector and adapter arrangement for the connection of a hard diskdrive to a circuit board. According to this design, an electric adapter B is used to connect a first electric connector A to a second electric connector C. The first electric connector A has a horizontal insertion slot A1 horizontally disposed on the middle between two distal ends thereof, and two rows of terminals respectively disposed at top and bottom sides of the horizontal insertion slot A1. The electric adapter B comprises a horizontal insertion board B2 disposed at the front side for insertion into the horizontal insertion slot A1 of the first electric connector A, two rows of terminal slots B1 respectively extended through front and rear sidewalls thereof at top and bottom sides of the horizontal insertion board B2, and a plurality of terminals (not shown) respectively inserted in the terminal slots B1. The second electric connector C has two rows of terminals C1 disposed at different elevations and respectively inserted into the terminal slots B1 to contact the respective terminals of the electric adapter B. When inserted the horizontal insertion board B2 into the horizontal insertion slot A1, the terminals of the electric adapter B are respectively forced into the respective terminals of the first electric connector A. This electric connector and adapter arrangement has drawbacks. Because the terminals are arranged at different elevations, the connector and the adapter have a certain thickness (height). Further, the adapter B can only be inserted into the first connector A horizontally from the front side. This installation limits the application of the electric connector and adapter arrangement to different computers.

SUMMARY OF THE INVENTION

The present invention has been accomplished to provide an electric connector and adapter arrangement, which eliminates the aforesaid drawbacks. It is one object of the present invention to provide an electric connector and adapter arrangement, which requires less installation space. It is another object of the present invention to provide an electric connector and adapter arrangement, which is inexpensive to manufacture. According to one aspect of the present invention, the housing of the electric connector defines a series of terminal chambers each having a top entrance and a front entrance, and the housing of the electric adapter has a plurality of vertical insertion strips that can be inserted with the electric adapter into the terminal chambers from the top entrance or front entrance to force the terminals of the electric adapter into close contact with the terminals of the electric connector. According to another aspect of the present invention, the terminals of the electric connector and electric adapter are respectively made of metal sheet material by stamping, so that the manufacturing cost of the terminals is low.

DETAILED DESCRIPTION OF THE PREFERRED EMBODIMENT

Figure 1:
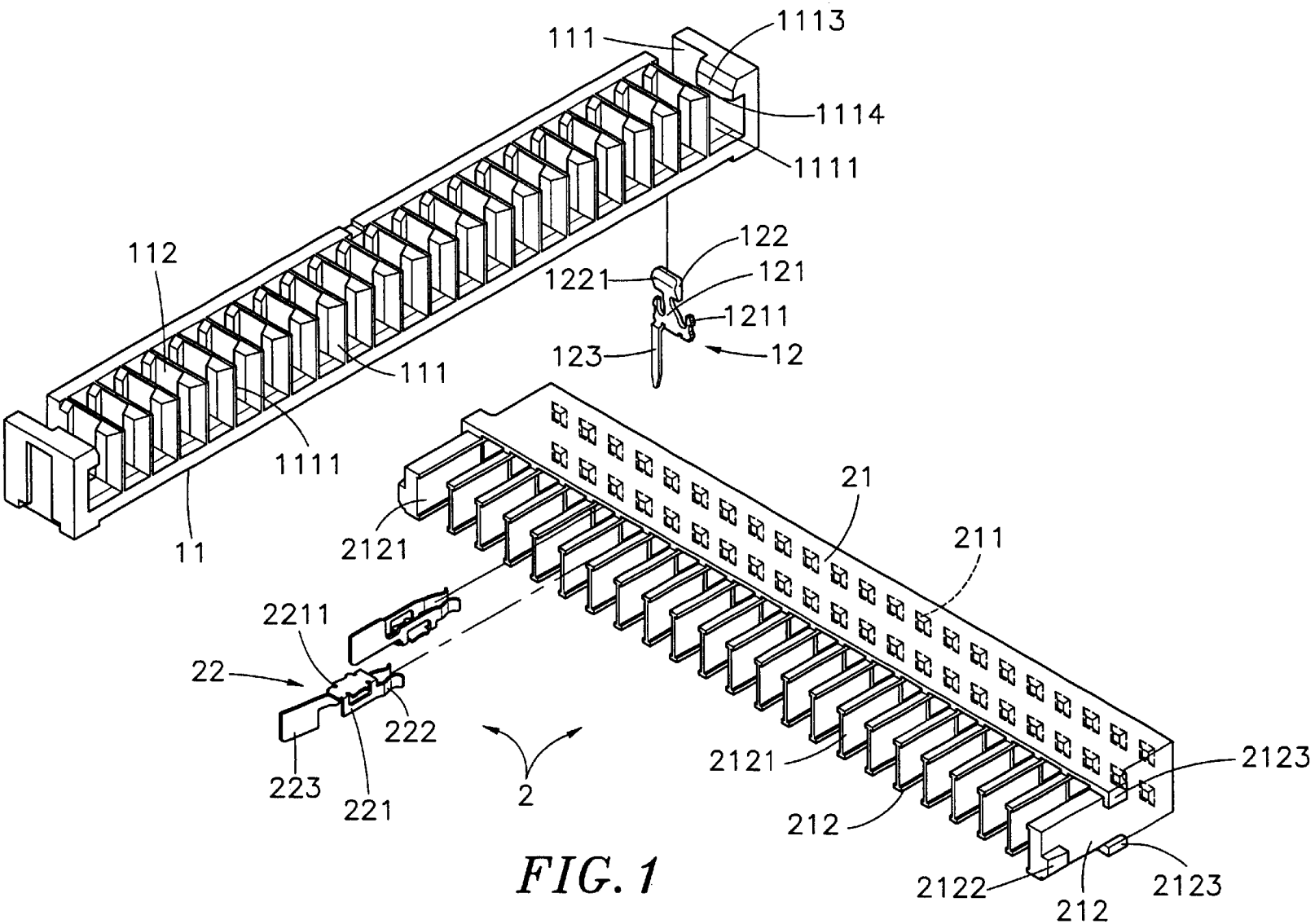
FIG. 1 is an exploded view of an electric connector and adapter arrangement according to the present invention.
Figure 2:
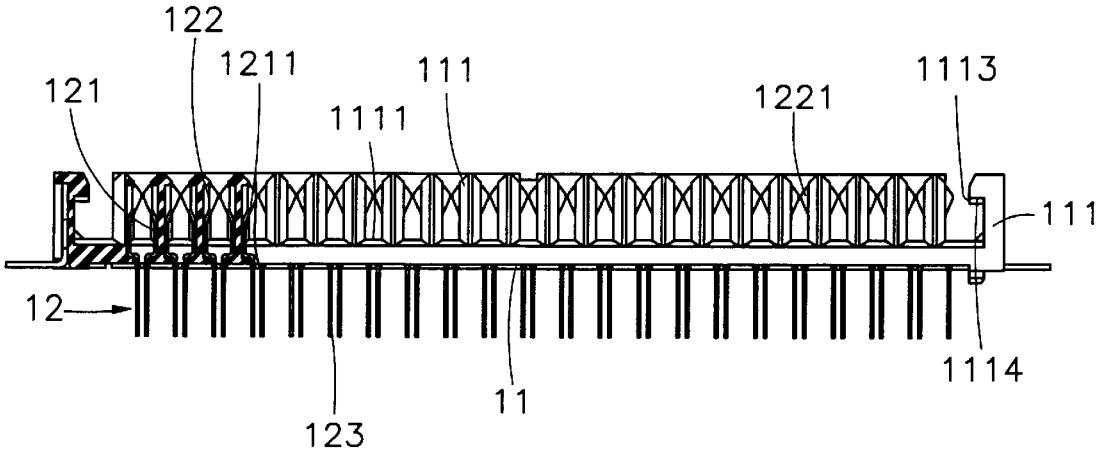
FIG. 2 is a side plain view partially in section of the electric connector for the electric connector and adapter arrangement according to the present invention.
Figure 3:
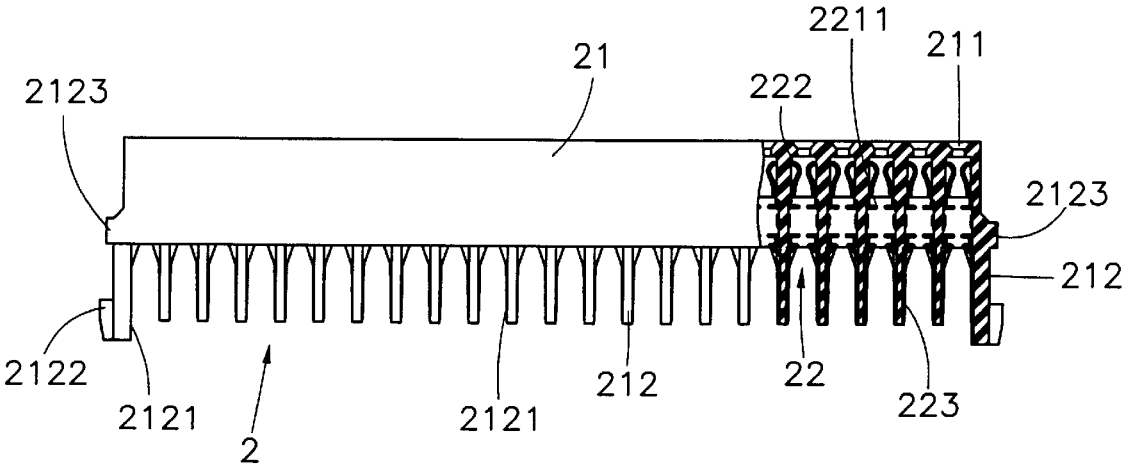
FIG. 3 is a top plain view partially in section of the electric adapter for the electric connector and adapter arrangement according to the present invention.

Referring to FIGS. 1, 2, 3, 6, and 7, an electric connector and adapter arrangement in accordance with the present invention is shown comprised of an electric connector 1, and an electric adapter 2.

The electric connector 1 is comprised of an electrically insulative housing 11, and a plurality of terminals 12 respectively installed in the housing 11. The housing 11 comprises a plurality of upright transverse walls 111 arranged in parallel, a plurality of vertical insertion slots 112 respectively defined in between each two adjacent upright transverse walls 111 and adapted to receive the terminals 12 respectively, a plurality of horizontal insertion holes 1111 respectively defined in between each two adjacent upright transverse walls 111 in communication with the vertical insertion slots 112. The first and last upright transverse walls 111 each have an inwardly protruded top guide block 1113. The guide block 1113 has a beveled front guide face 1114. The terminals 12 are respectively mounted in the vertical insertion slots 112, each comprising a base 121, two barbed portions 1211 bilaterally extended from the base 121 and respectively engaging the upright transverse walls 111 at two sides of the respective vertical insertion slot 112, a top contact head 122 suspended in the respective vertical insertion slot 112, the contact head 122 having a convex contact portion 1221 disposed at one lateral side, and a vertical bottom mounting leg 123 extended out of the bottom sidewall of the housing 11 for fastening to a respective contact hole in a circuit board 3 (see FIG. 7).

Figure 4:
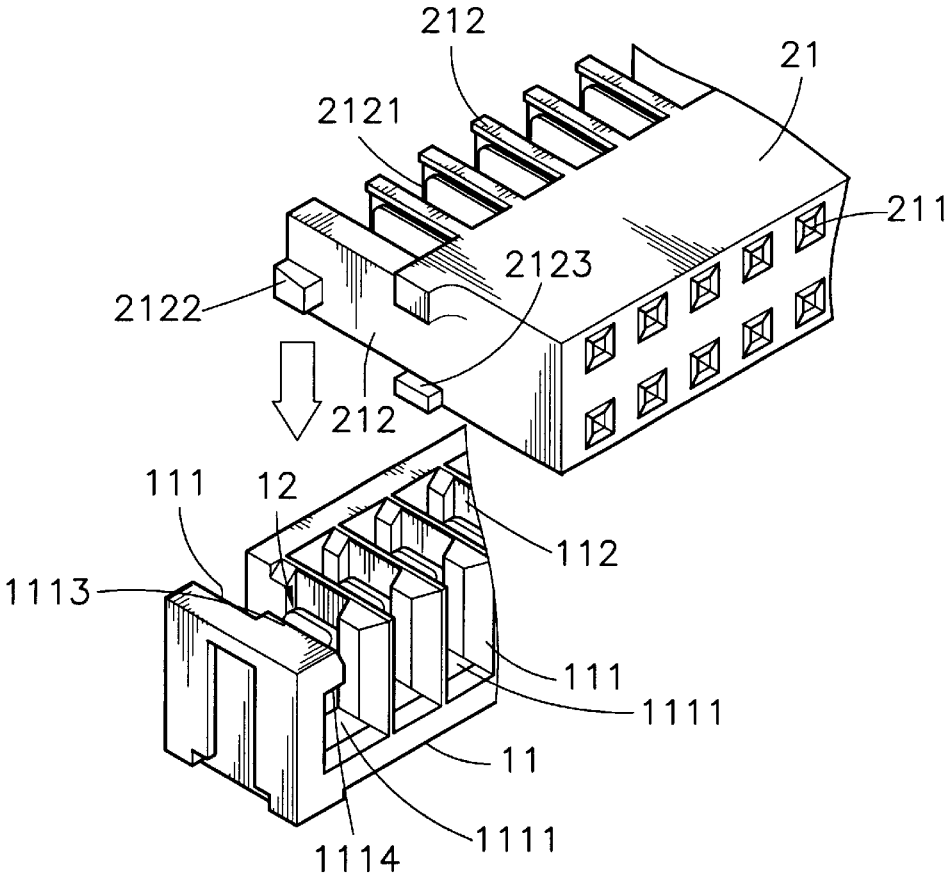
FIG. 4 shows one installation example of the electric adapter in the electric connector according to the present invention.
Figure 5:
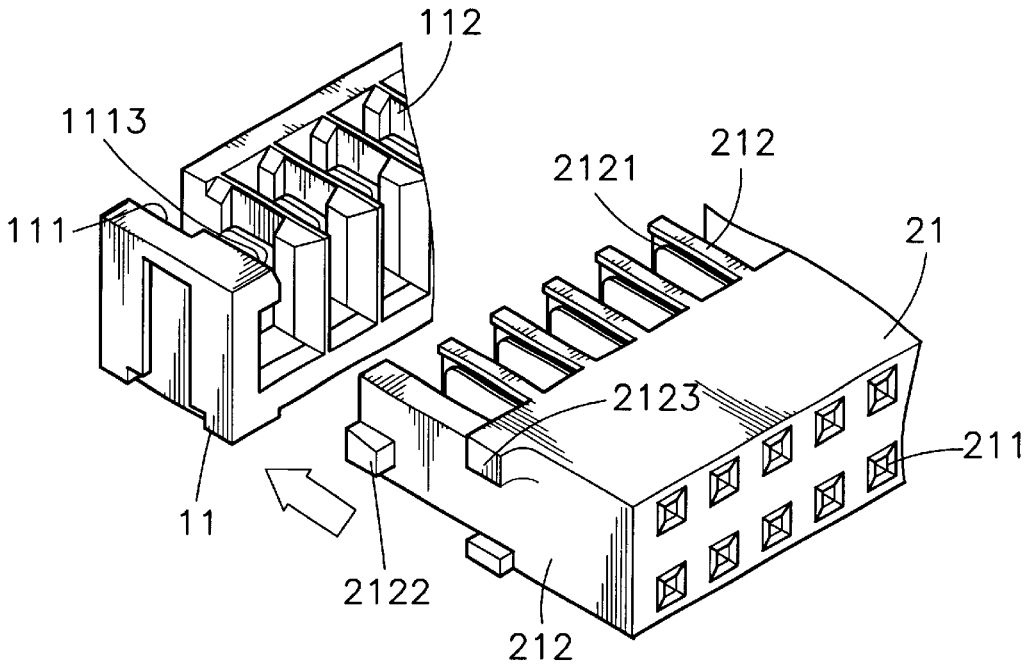
FIG. 5 shows a second installation example of the electric adapter in the electric connector according to the present invention.
Figure 6:
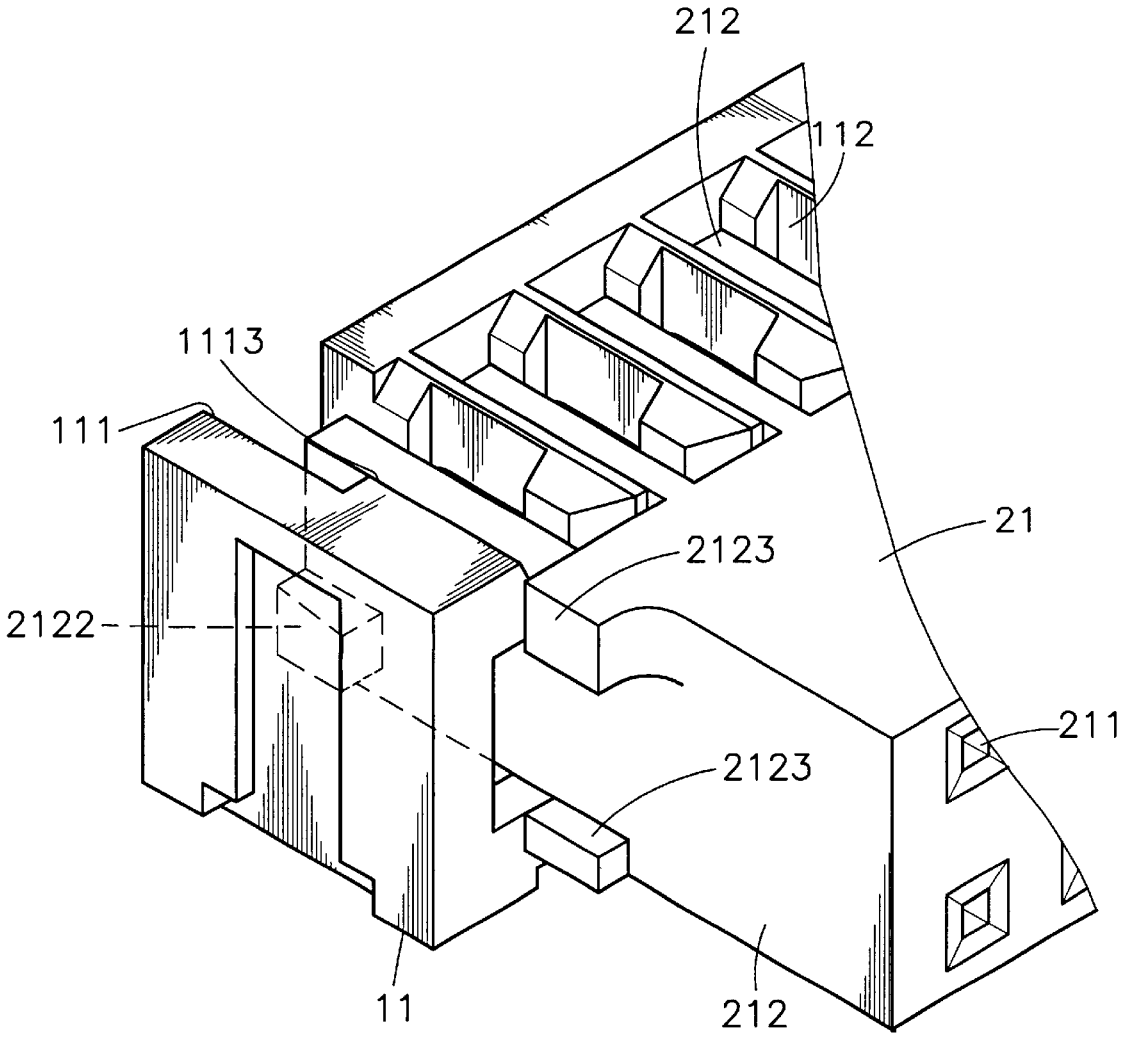
FIG. 6 is a perspective view of a part of the present invention, showing the electric adapter fastened to the electric connector.
Figure 7:
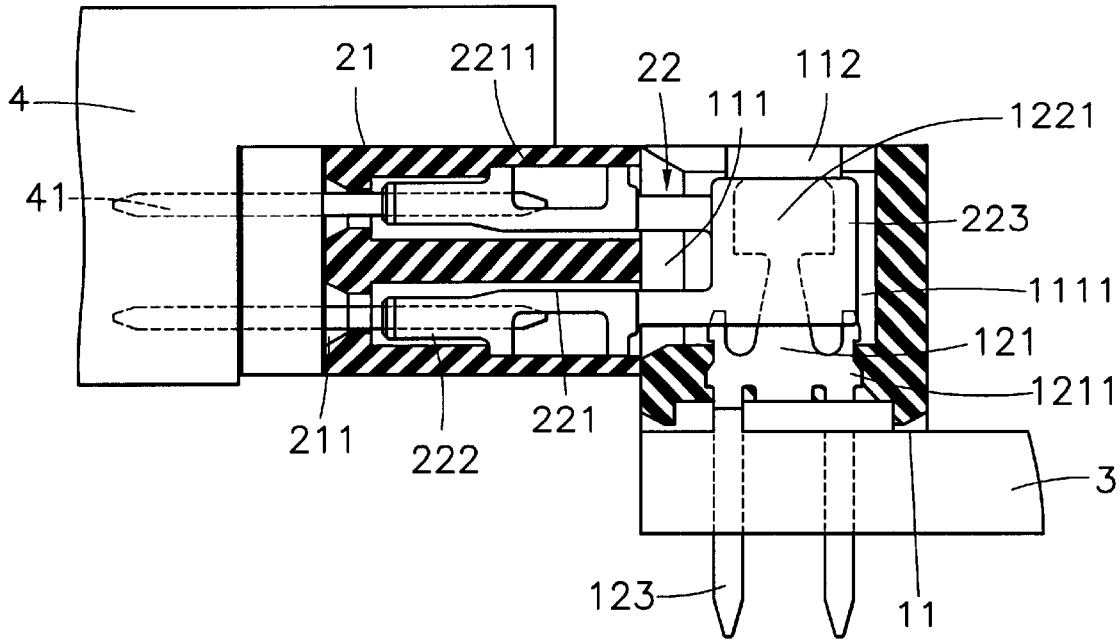
FIG. 7 is a side view in section showing the electric adapter fastened to the electric connector according to the present invention.

The electric adapter 2 is comprised of an electrically insulative housing 21, and a plurality of terminals 22 respectively installed in the housing 21. The housing 21 comprises a plurality of vertical insertion strips 212 arranged in parallel and respectively inserted into the horizontal insertion holes 1111 of the housing 11 of the electric connector 1 in vertical direction from the top side (see FIG. 4) or horizontal direction from the front side (see FIG. 5), a plurality of terminal slots 211 respectively extended through the upright back sidewall thereof and arranged into two vertically spaced rows. The first and last insertion strips 212 each have a retaining block 2122 respectively stopped against the first and last upright transverse walls 111 of the electric connector 1 at an inner side, and two stop blocks 2123 respectively stopped against the first and last upright transverse walls 111 of the electric connector 1 at an outer side. The insertion strips 212 of the housing 21 of the electric adapter 2 except the first and last insertion strips 212, each further have a substantially I-shaped cross section defining two positioning grooves 2121 at two opposite sides. The first and last insertion strips 212 of the housing 21 of the electric adapter 2 each have only one positioning groove 2121 at an inner side. The terminals 22 each have a base 221 inserted into one terminal slot 211, a barbed portion 2211 protruded from the base 221 and engaging the peripheral wall of the respective terminal slot 211, a front contact portion 223 positioning in one positioning groove 2121 of one insertion strip 212 and inserted with the respective insertion strip 212 into one horizontal insertion hole 1111 of the housing 11 of the electric connector 1 and maintained in close contact with the convex contact portion 1221 of one terminal 12 of the electric connector 1, and a rear receiving tail terminating in a forked clamping portion 222 adapted to clamp a respective terminal of an external connector.

Furthermore, the terminals 12 of the electric connector 1 and the terminals 22 of the electric adapter 2 are respectively made of metal sheet material by stamping. Because the terminals 12 and 22 are respectively made in integrity by stamping, the manufacturing cost of the terminals 12 and 22 is low.

Figure 8:
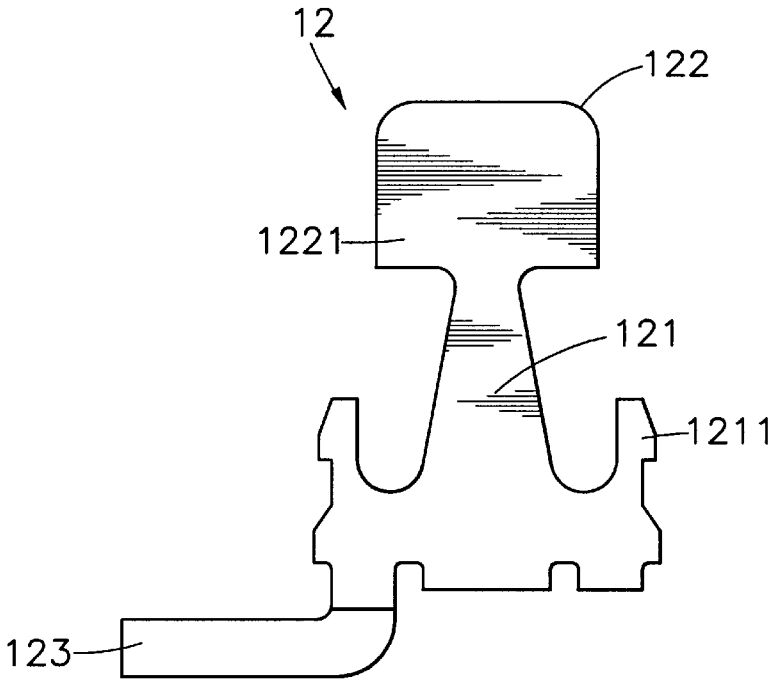
FIG. 8 is a front view of an alternate form of the terminal for the electric connector according to the present invention.
Figure 9:
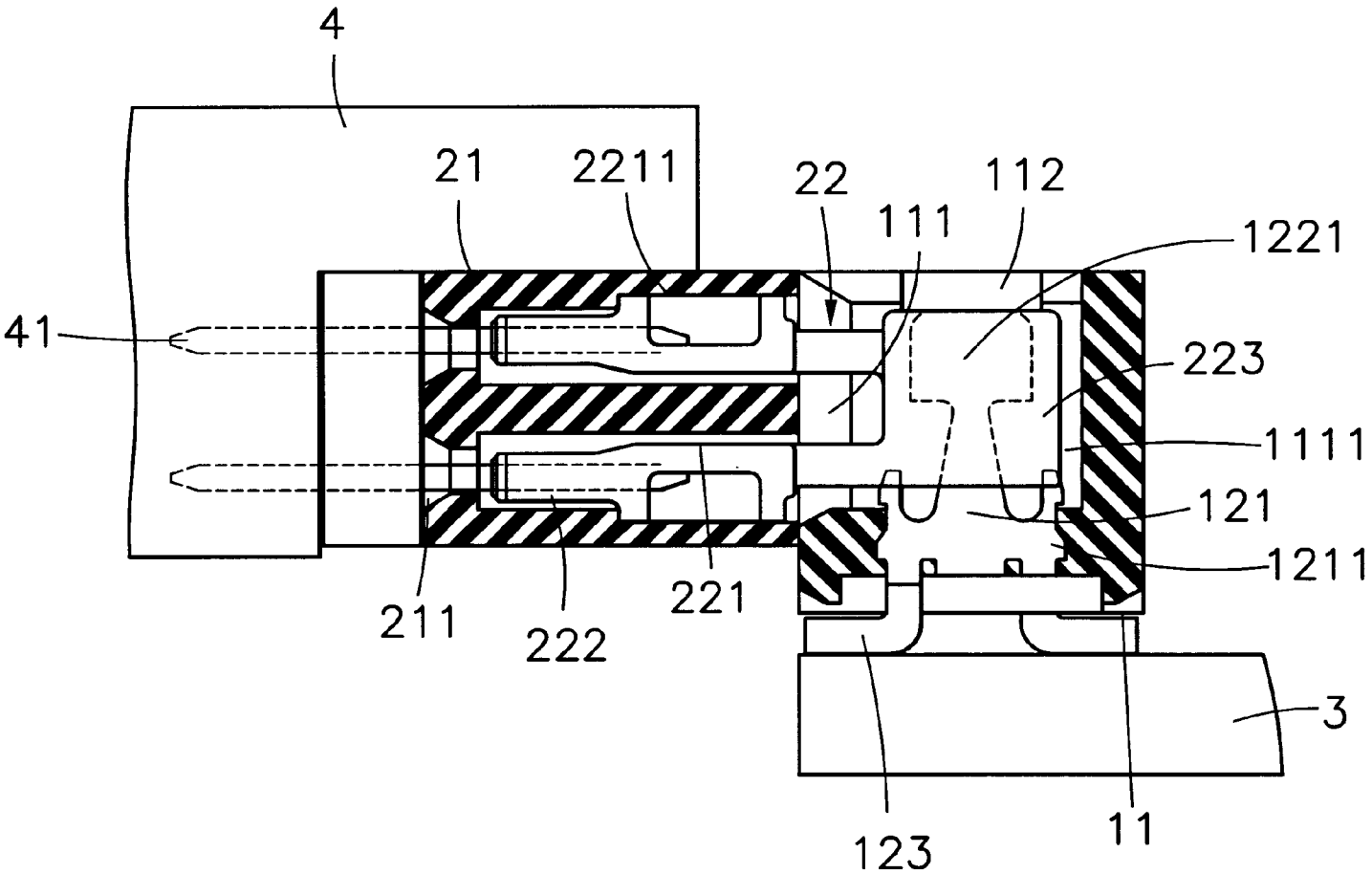
FIG. 9 is a sectional view of an alternate form of the present invention, showing the horizontally extended bottom mounting leg of the terminal of the electric connector mounted on the surface of the circuit board.
Figure 10:
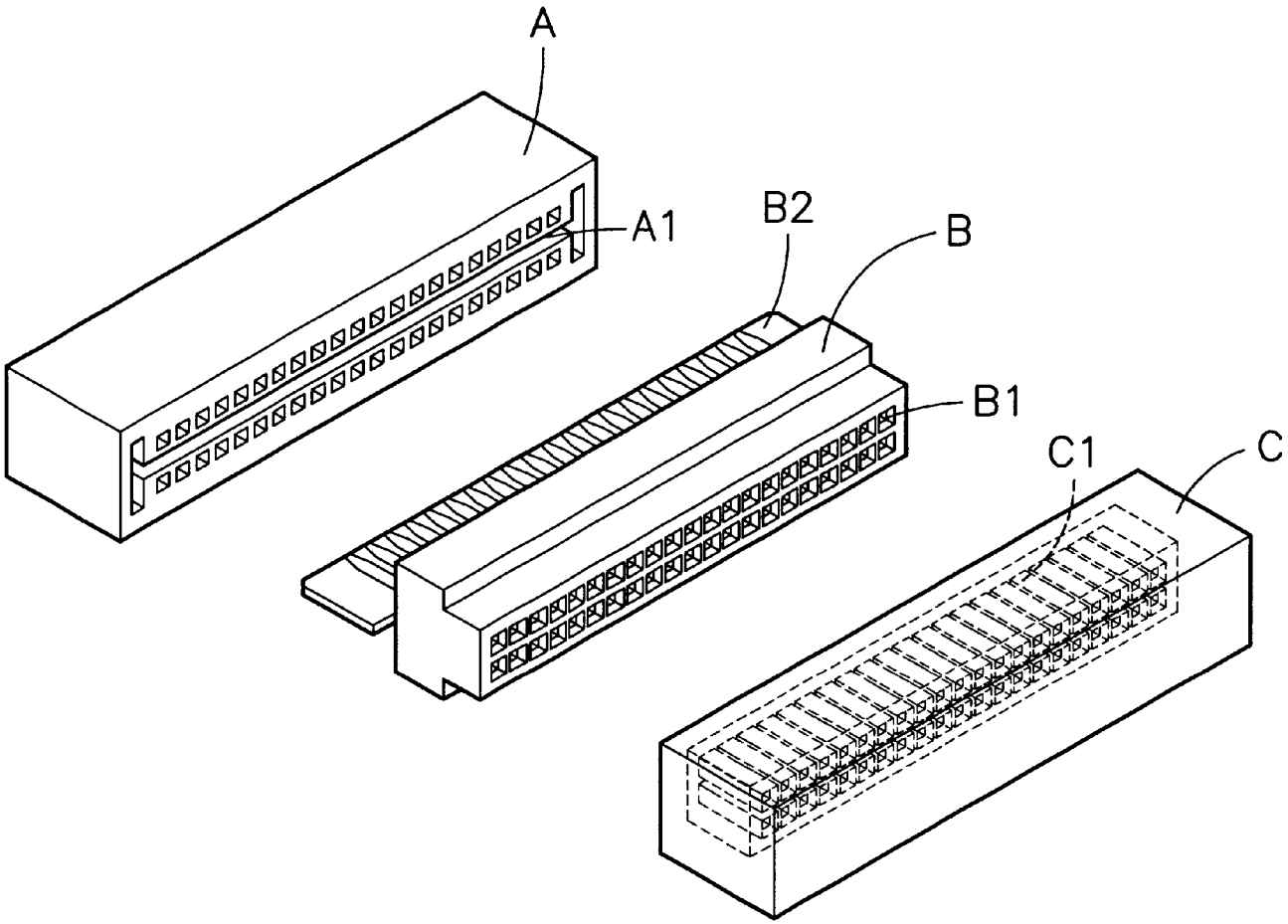
PRIOR ART FIG. 10
FIG. 10 is an exploded view of the prior art.
Figure 11:
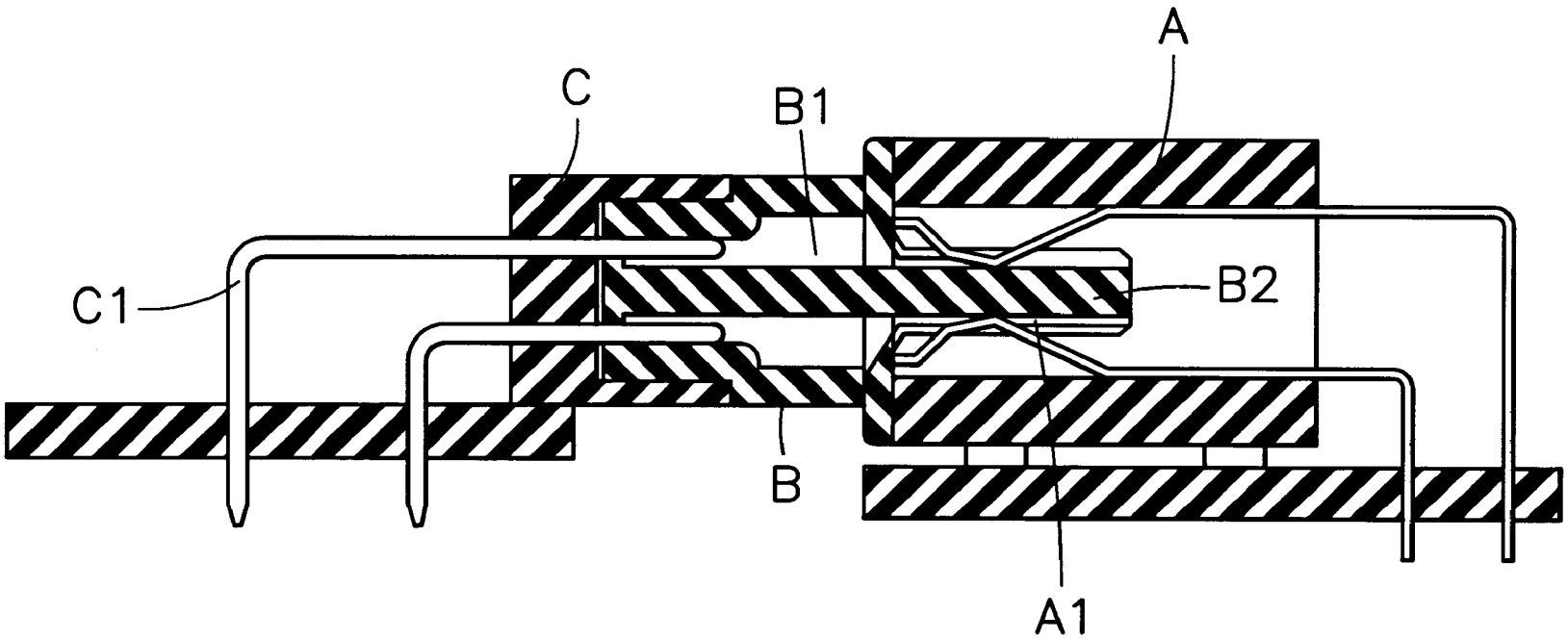
PRIOR ART FIG. 11
FIG. 11 is a sectional view of the prior art.

FIGS. 8 and 9 show an alternate form of the present invention. According to this alternate form, each terminal 12 of the electric connector 1 has a horizontally extended bottom mounting leg 123 disposed outside the bottom sidewall of the housing 11 for fastening to a respective contact on the top sidewall of circuit board 3 by a surface mounting technique.

As indicated above, the design of the vertical insertion strips 212 greatly minimizes the dimensions of the electric adapter 2. Each vertical insertion slot 112 of the electric connector 1 forms with the corresponding horizontal insertion hole 1111 a respective terminal chamber having a top entrance and a front entrance so that the electric adapter 2 can be directly horizontally inserted into the horizontal insertion holes 1111 of the housing 11 of the electric connector 1, or vertically inserted into the vertical insertion slots 112 from the top side and then forced into the horizontal insertion holes 1111. Further, the modularized design of the terminals 12 and 22 greatly reduce the manufacturing cost of the present invention.

A prototype of electric connector has been constructed with the features of the annexed drawings of FIGS. 1~7. The electric connector functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electric connector and adapter arrangement comprising an electric connector and an electric adapter adapted to connect said electric connector to an external electric device, said electric connector comprising an electrically insulative housing and a plurality of terminals respectively mounted therein and arranged in pairs, said electric adapter comprising an electrically insulative housing having two vertically spaced rows of terminal slots, and a plurality of terminals respectively mounted therein and inserted into said electric connector into contact with the terminals of said electric connector, wherein the housing of said electric connector comprises a plurality of upright transverse walls arranged in parallel, a plurality of vertical insertion slots respectively defined between each two adjacent upright transverse walls, a plurality of horizontal insertion holes respectively defined between each two adjacent upright transverse walls in communication with said vertical insertion slots; the terminals of said electric connector are respectively mounted in said vertical insertion slots, each comprising a base positioned in one vertical insertion slot, a top contact head suspended in the respective vertical insertion slot, and a vertical bottom mounting leg extended out of a bottom sidewall of the of said electric connector for connection to a circuit board housing; the housing of said electric adapter comprises a plurality of vertical insertion strips arranged in parallel and respectively engaged into the horizontal insertion holes of the housing of said electric connector; the terminals of said electric adapter each comprise a base positioned in one terminal slot, a front contact portion supported on one insertion strip at one side and inserted with the respective insertion strip into one horizontal insertion hole of said electric connector and maintained in close contact with one terminal of said electric connector, and a rear receiving tail suspended in the corresponding terminal slot and adapted to receive a respective terminal from an external connector.

2. The electric connector and adapter arrangement as claimed in claim 1 wherein each terminal of said electric adapter comprises two barbed portions protruding from the respective base at two sides thereof and forced into engagement with the peripheral wall of the respective terminal slot.

3. The electric connector and adapter arrangement as claimed in claim 1 wherein the rear receiving tail of each terminal of said electric adapter terminates in a forked clamping portion adapted to clamp a respective terminal from an external connector.

4. The electric connector and adapter arrangement as claimed in claim 1 wherein the vertical insertion slots of said electric connector respectively define with the horizontal insertion holes of said electric connector a respective terminal chamber having a top entrance and a front entrance.

5. The electric connector and adapter arrangement as claimed in claim 4 wherein the terminals of said electric connector each have two barbed portions bilaterally extending from the respective base and respectively forced into engagement with said upright transverse walls at two sides of each of said vertical insertion slots.

6. The electric connector and adapter arrangement as claimed in claim 5 wherein the top contact head of each terminal of said electric connector has a convex contact portion disposed at one lateral side for making contact with the front contact portion of one terminal of said electric adapter.

7. The electric connector and adapter arrangement as claimed in claim 1 wherein the upright transverse walls of said electric connector include a first upright transverse wall and a last upright transverse wall, said first upright transverse wall and said last upright transverse wall each having an inwardly protruding top guide block adapted to guide said electric adapter into said electric connector; the vertical insertion strips of said electric adapter include a first insertion strip and a last insertion strip, said first insertion strip and said last insertion strip each comprise a retaining block stopped against one of the first upright transverse wall and last upright transverse wall of said electric connector at an inner side thereof, and at least one stop block stopped against one of the first upright transverse wall and last upright transverse wall of said electric connector at an outer side thereof.

8. The electric connector and adapter arrangement as claimed in claim 7 wherein said inwardly protruding top guide block has a beveled front guide face.

9. The electric connector and adapter arrangement as claimed in claim 7 wherein said first insertion strip and said last insertion strip each comprise two stop blocks disposed at different elevations and respectively stopped against one of the first upright transverse wall and last upright transverse wall of said electric connector at an outer sides thereof.

* * * * *